United States Patent [19]

Klabin

[11] Patent Number: 4,889,279

[45] Date of Patent: Dec. 26, 1989

[54] SAFE FOR COLLECTING PUBLIC TELEPHONE TOKENS

[75] Inventor: Mauricio Klabin, Rio de Janeiro-RJ, Brazil

[73] Assignee: Mec-Prec Mecanica De Precisao Industria E Comercio Ltda., Rio de Janeiro, Brazil

[21] Appl. No.: 235,937

[22] Filed: Aug. 24, 1988

[51] Int. Cl.[4] ..... G07B 15/00

[52] U.S. Cl. ..... 232/15; 232/16

[58] Field of Search ..... 232/7, 9, 15, 16

[56] References Cited

U.S. PATENT DOCUMENTS

| | | | |
|---|---|---|---|
| 3,171,591 | 3/1965 | Long et al. | 232/16 X |
| 3,206,111 | 9/1965 | Labe | 232/15 |
| 3,292,849 | 12/1966 | Ewing | 232/15 X |
| 3,837,566 | 9/1974 | McGough | 232/15 |
| 3,948,376 | 4/1976 | Roman | 232/15 X |

*Primary Examiner*—Robert W. Gibson, Jr.

*Attorney, Agent, or Firm*—Bryan, Cave, McPheeters & McRoberts

[57] ABSTRACT

A token collecting safe (10) is described, which includes a parallelepipedal box that is provided with a fixed cover (15), including an upper cavity of semicircular shape (16) with handle (17), a rectangular opening with a recess (18) usually closed by means of sealing wax or a transparent sight-hole (20), an upper opening or device for token input (22) for token access to an upper token collecting trough (23) and a second token input device (24) for token access to a lateral token collecting trough (25). The token collecting troughs (23, 25) are built from a plastic material and are provided with slots (28, 31) in their respective free ends to ensure the irreversible fall of the telephone tokens into the safe.

2 Claims, 5 Drawing Sheets

FIG.3
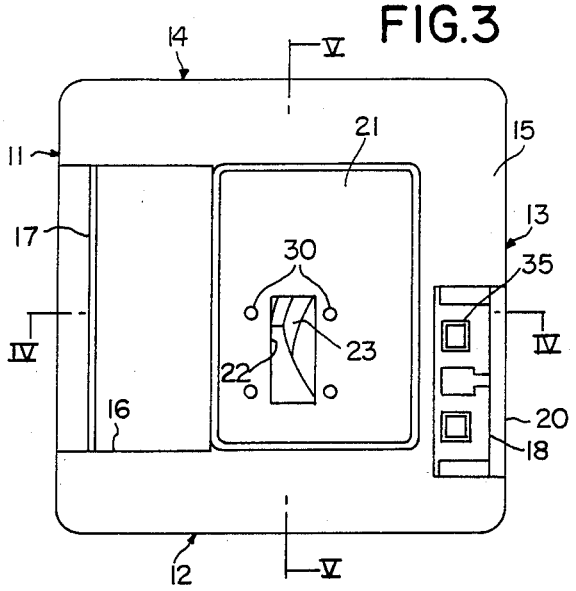
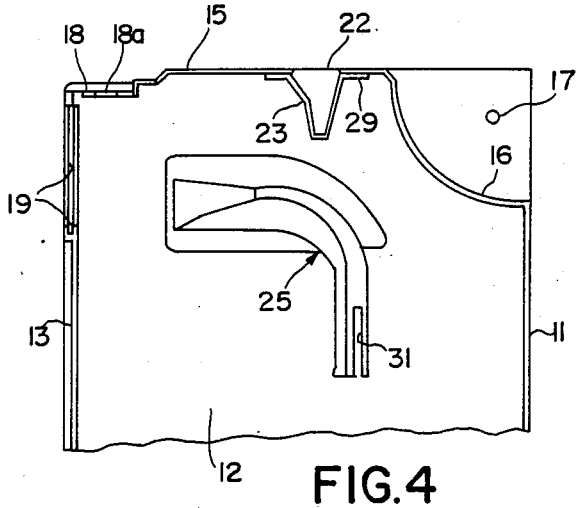
FIG.4

SAFE FOR COLLECTING PUBLIC TELEPHONE TOKENS

BACKGROUND OF THE INVENTION

The present invention relates to a safe suitable for collecting public telephone tokens.

SUMMARY OF THE INVENTION

The safe of the invention includes a box with a cover of substantially parallelepipedal shape which is provided with an upper cavity having a handle, upper and lateral input devices for receiving tokens, and a breakable sealing wax device. The sealing wax device allows for removal of the tokens accumulated inside the safe and is numbered to make it possible to control access to and operation of the safe.

BRIEF DESCRIPTION OF THE DRAWINGS

The purposes and other aspects of the present invention may be more easily understood from the following description, when read, jointly with the attached drawings, in which:

FIG. 3 is an upper plane view of the safe shown in FIGS. 1 and 2.

FIG. 4 is a cross-sectional view of the upper Portion of the safe, observed along line IV—IV of FIG. 3.

DESCRIPTION OF THE PREFERRED EMBODIMENTS

Figure 1:
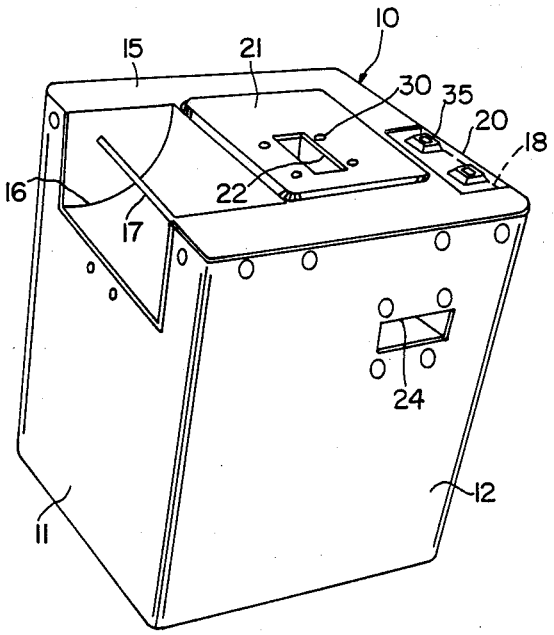
FIG. 1 is a perspective view of a safe for collecting public telephone tokens according to the present invention.
Figure 2:
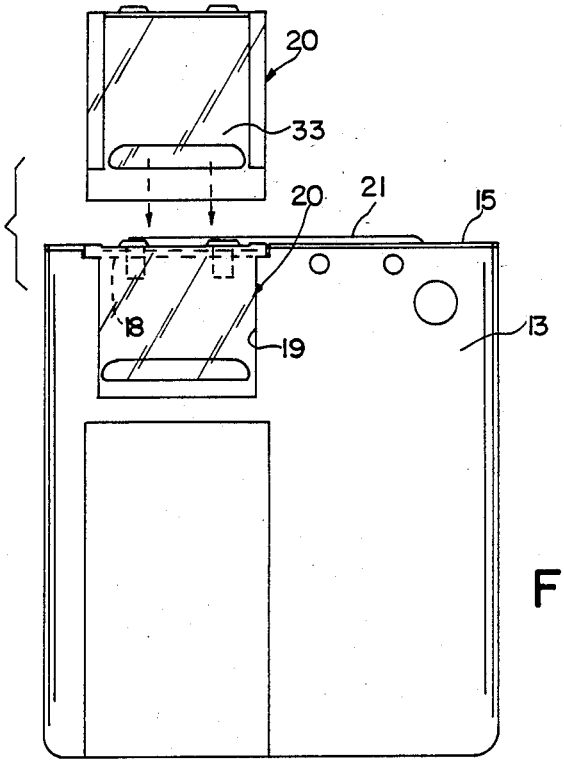
FIG. 2 is a lateral elevation view of the safe shown in FIG. 1, observed from the side where the sealing wax is located.
Figure 5:
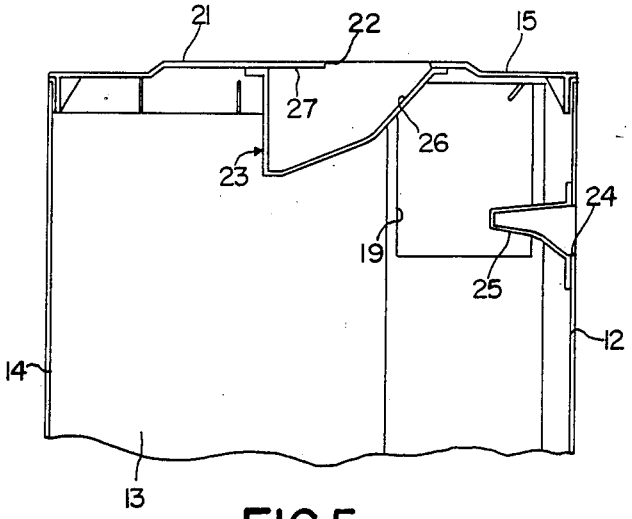
FIG. 5 is a cross-sectional view of the upper portion of the observed along the cutting line V—V of FIG. 3.

As may be seen from the drawings, the present invention relates to a safe for collecting public telephone tokens shown in the form of a parallelepipedal box 10. The box 10 may be manufactured from a suitable plastic material, such as high-density polyethylene (HDPE). The box is defined by vertical walls 11, 12, 13 and 14, a rear wall (not shown) and a top surface or cover 15. In an upper portion of one of the sides of the box 10 is a semicircular cavity 16. A stainless steel stem 17 of suitable diameter is provided in cavity 16 to define a handle for holding the safe during transportation, installation and/or removal from a telephone apparatus.

In the side opposed to the side having the semicircular cavity 16, box 10 has a rectangular opening in the upper portion of which is a rectangular recess 18 for purposes of supporting sealing wax 20. Box 10 is provided with two slots 18*a* designed to provide orientation and fitting to two lock pins or fastening pins 37 which are described hereinbelow. The tokens are removed through the rectangular opening which is almost entirely located in the side wall 13 provided with side fitting guides 19. Side fitting guides 19 receive, through a sliding movement, the sealing wax 20, which is manufactured from a suitable plastic material, and is shown in greater detail in FIG. 9.

The sealing wax 20 defines a sight-hole which is preferably numbered with internal control numbers. The transparent plastic material from which sealing wax 20 is manufactured is breakable, so as to allow authorized access to the contents of the safe 10, when desired. The numbers are intended to control utilization and operation of the safe.

Figure 7:
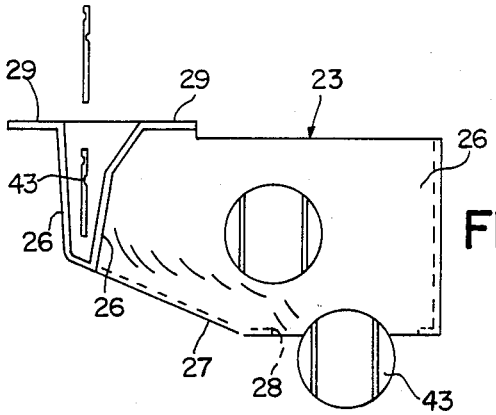
FIG. 7 is a lateral view of the input device for receiving telephone tokens shown in FIG. 6.
Figure 8:
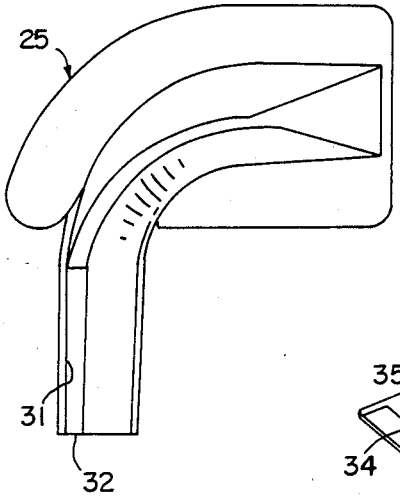
FIG. 8 is a front view of the input device for receiving telephone tokens located at the side wall of the safe.

As may be seen from the drawings, the central portion of the cover 15 includes a protruding section or rectangular table 21. Asymmetrically located within protruding section 21 is an input device through which tokens 22 may access an upper token collecting trough or irreversible upper path 23 which is shown in detail in FIGS. 6 and 7. A second token input device 24 is located in wall 12 of box 10 along with a second lateral token collecting trough 25, as illustrated in FIG. 8.

Figure 6:
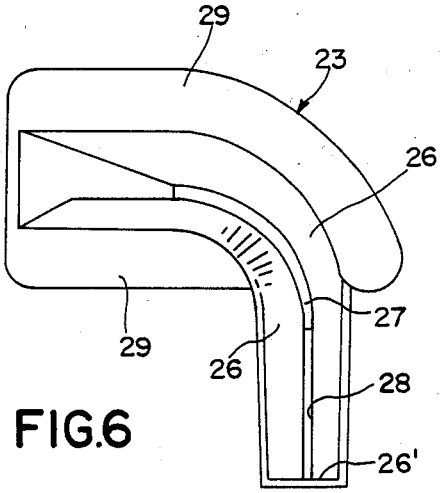
FIG. 6 is an upper plane view of the input device for receiving telephone tokens located at the upper portion or cover of the safe.

As shown in FIG. 6, the token collecting trough or irreversible upper path 23, which is preferably moulded from high-density polyethylene, has the shape of a funnel which extends laterally along a 90° curve. Trough 23 has inclined lateral walls 26 and a down-sloping bottom 27 which is provided with a slot 28 at its internal free extreme portion. A wall 26 closes the free end of the trough 23. In the upper portion of the trough 23 is a rim or flange 29, by means of which the trough 23 is attached to the internal face of the cover wall 15. Trough 23 may be attached to cover wall 15, e.g., by ultrasound welding at points 30 in FIGS. 1 and 3.

In operation, trough 23 allows conventional telephone tokens 43 to be introduced through the input device 22, to fall into the funnel-shaped section, to roll along the trough and to pass through the slot 28, falling then into the safe 10. Tokens 43 may be removed from safe 10 through the lateral window or opening only when the sealing wax 20 is broken.

The lateral token collecting trough 25 (see FIG. 8) is of similar construction to that of the upper trough 23. However, the extreme portion of trough 25 adjacent to slot 31 remains open for the fall of telephone tokens 43, as indicated at 32, and not closed as with the upper trough 23.

Figure 9:
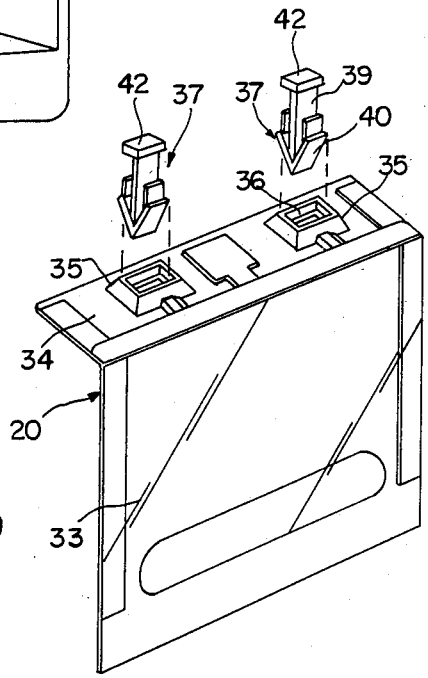
FIG. 9 shows a view in perspective of the sealing wax or breakable seal utilized in the safe of the previous figures, with lock pins in position to be inserted and to be attached with sealing wax or a breakable seal in position on the safe (not shown in this figure).
Figure 10:
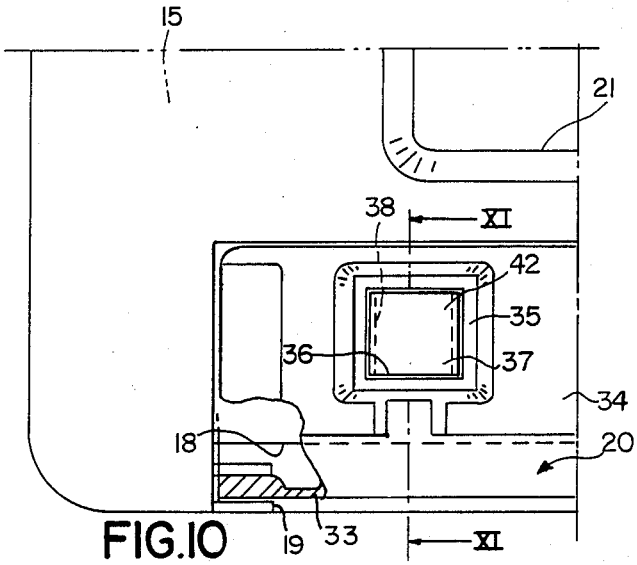
FIG. 10 is an enlarged detail view of the upper right section or corner of FIG. 3, showing the sealing wax or breakable seal configuration when fitted in the safe.
Figure 11:
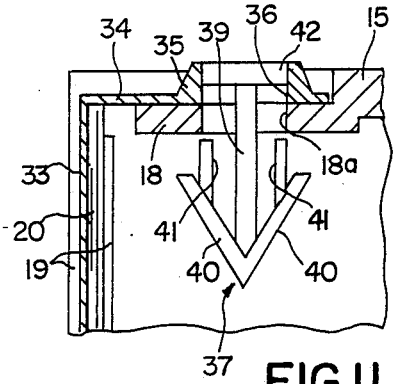
FIG. 11 is a cross-sectional view observed along the cutting line XI—XI of FIG. 10.

The seal or sealing wax 20, as shown in detail in FIGS. 9, 10 and 11 and described previously, has the shape of a sight-hole. Sealing wax 20 is preferably moulded from a transparent high-impact polystyrene in a substantially rectangular shape and with a cross-section in the shape of an inverted "L". The inverted "L" shape is defined by a larger rectangular portion 33 which is received between the side fitting guides 19 of the rectangular opening, and a smaller rectangular portion 34, which is arranged on or supported by the recess 18 formed at the cover 15.

A pair of protuberances 35 in the shape of truncated pyramids extends from the outside face of rectangular portion 34. Protuberances 35 are each provided with a central opening 36, designed to receive a lock pin 37.

The openings 36 are positioned to coincide with the two slots 18*a* formed in the recess 18, thereby providing a non-removable fitting for the two lock pins 37 which are typically moulded from polypropylene. As may be seen from FIG. 11, lock pin 37 includes a flat rectangular head which fits into opening 36 and is supported below against two recesses 38 (see FIG. 10), a section of descending dowel 39 and two rims 40 obliquely arranged in the shape of a "V". Retainer elements 41 block the outlet of lock pins 37 after the lock pins are inserted in openings 36 and slots 18*a*.

Thus, once sealing wax 20 is fitted in position as shown in FIGS. 1, 2, 10 and 11, it may be removed from the opening to allow access into the safe only when it is broken or destroyed.

Having thus described the invention, what is claimed is:

1. A safe for receiving and collecting public telephone tokens, comprising a parallelepipedal box defined by side walls, a rear wall and a cover integrally attached to said side walls, wherein a first side wall of said box has a semicircular cavity in its upper section, said cavity having a metallic handle therein, a second wall opposite said first wall has a rectangular recess provided with orientation slots, a sealing wax is provided which is fittable into lateral guides in said rectangular recess, said sealing wax being held in position by non-removable lock pins, said cover has a recessing table having an asymmetric opening which leads to a token collecting trough, said trough being provided with a slot at its free end, and one of said side walls has an opening which leads to a second token collecting trough which is provided with a slot at its free end.

2. The safe of claim 1, wherein said asymmetric opening in said recessing table comprises a first token input device.

* * * * *

UNITED STATES PATENT AND TRADEMARK OFFICE

CERTIFICATE OF CORRECTION

PATENT NO. : 4,889,279

DATED : December 26, 1989

INVENTOR(S) : Mauricio Klapin

It is certified that error appears in the above-identified patent and that said Letters Patent is hereby corrected as shown below:

Column 1, line 31: change "Portion" to --portion--

Column 1, line 34: before "observed" insert --safe,--

Signed and Sealed this

Twenty-first Day of May, 1991

*Attest:*

*Attesting Officer*

HARRY F. MANBECK, JR.

*Commissioner of Patents and Trademarks*